US010918922B2

(12) United States Patent
Brey et al.

(10) Patent No.: US 10,918,922 B2
(45) Date of Patent: Feb. 16, 2021

(54) POLYGONAL BASKETBALL HOOP ARRANGEMENT

(71) Applicant: Brego 360 Holdings, LLC, Lake Mary, FL (US)

(72) Inventors: Shane Brey, Sanford, FL (US); Anthony Gomez, Sanford, FL (US)

(73) Assignee: Brego 360 Holdings, LLC, Lake Mary, FL (US)

( * ) Notice: Subject to any disclaimer, the term of this patent is extended or adjusted under 35 U.S.C. 154(b) by 0 days.

(21) Appl. No.: 16/661,984

(22) Filed: Oct. 23, 2019

(65) Prior Publication Data

US 2020/0122010 A1 Apr. 23, 2020

Related U.S. Application Data

(60) Provisional application No. 62/749,455, filed on Oct. 23, 2018.

(51) Int. Cl.
*A63B 63/08* (2006.01)
*A63B 71/02* (2006.01)

(52) U.S. Cl.
CPC ..... *A63B 63/083* (2013.01); *A63B 71/023* (2013.01); *A63B 2071/026* (2013.01); *A63B 2225/093* (2013.01); *A63B 2243/0037* (2013.01)

(58) Field of Classification Search
CPC ..... A63B 63/083; A63B 71/023; A63B 2071/026; A63B 2225/093;
(Continued)

(56) References Cited

U.S. PATENT DOCUMENTS 611,504 A * 9/1898 Perky ..... A63B 67/06 273/400
1,211,379 A * 1/1917 Maisch ..... A63F 9/02 273/368

(Continued)

FOREIGN PATENT DOCUMENTS

DE 19512890 10/1996
GB 2317833 A * 4/1998 ..... A63B 63/08

OTHER PUBLICATIONS

PCT International Searching Authority: PCT/US2019/057734; International Search Report and Written Opinion dated Jan. 10, 2020; entire document.

*Primary Examiner* — Mitra Aryanpour
(74) *Attorney, Agent, or Firm* — Allen Dyer Doppelt & Gilchrist, PA

(57) ABSTRACT

A basketball hoop arrangement includes three basketball backboards and hoops commonly connected to the upper end of a support structure. The backboards are arranged such that respective top and bottom edges thereof form triangles with respective front surfaces of the three basketball backboards facing outwards and respective rear surfaces of the three basketball backboards facing inwards. Each hoop is connected to a different one of the respective front surfaces and extends outwardly therefrom. A lower end of the support structure is configured to support the support structure and the three basketball backboards on an underlying surface. A basketball game is played by moving a basketball in a playing area extending around all of the at least three backboards, and scoring points by putting the basketball through any one of the at least three hoops.

17 Claims, 4 Drawing Sheets

(58) Field of Classification Search
CPC ... A63B 2243/0037; A63B 67/06; A63B 9/02; A63B 63/00; A63B 63/08; A63B 23/0211
USPC ..... 473/470–479, 433, 422, 447; 273/400, 273/368, 407, 317.3, 402, 375; 482/148, 482/82–89
See application file for complete search history.

(56) References Cited

U.S. PATENT DOCUMENTS

D139,311 S * 10/1944 Gibson ..... D21/702
2,379,572 A * 7/1945 Gibson ..... A63B 63/083 248/158
3,050,304 A * 8/1962 Hulsebus ..... A63B 63/083 473/447
3,134,594 A * 5/1964 Crowley ..... A63B 63/083 473/433
3,201,126 A * 8/1965 Nissen ..... A63B 5/11 273/393
4,226,416 A * 10/1980 Callanan ..... A63B 69/0071 473/448
4,266,763 A * 5/1981 Collins ..... A63B 63/083 473/481
4,569,515 A * 2/1986 Gordon ..... A63B 5/11 473/473
5,224,699 A * 7/1993 Zaruba ..... A63B 21/1663 273/375
5,810,679 A * 9/1998 Yoakum ..... A63B 63/08 473/472
5,836,837 A * 11/1998 Craig ..... A63B 67/002 473/472
6,398,673 B1 * 6/2002 Maruca ..... A63B 21/1627 473/481
6,780,129 B1 * 8/2004 Higuchi ..... A63B 63/08 273/378
6,976,945 B1 * 12/2005 Lim ..... A63B 23/0211 482/148
7,223,186 B2 * 5/2007 Tresvant ..... A63B 69/0071 473/423
7,311,617 B2 * 12/2007 Langhorn ..... A63B 63/00 473/446
7,549,433 B2 * 6/2009 Zheng ..... A63B 9/00 473/471
7,938,746 B2 * 5/2011 Chipperfield ..... A63B 24/0021 473/434
8,480,402 B2 * 7/2013 Pecherski ..... A63F 9/06 434/258
D762,791 S * 8/2016 Pasquale ..... D21/701
D773,570 S * 12/2016 Pasquale ..... D21/702
2003/0134701 A1 7/2003 Nye
2003/0162611 A1 8/2003 Steed et al.
2004/0209714 A1 10/2004 Jesch et al.
2004/0214666 A1 * 10/2004 Dilling ..... A63B 63/00 473/470
2006/0288523 A1 12/2006 Willis
2010/0113190 A1 * 5/2010 Vysosias ..... A63B 63/08 473/481
2010/0210381 A1 8/2010 White
2014/0274489 A1 9/2014 Kurt
2018/0093150 A1 4/2018 Pratt
2019/0224545 A1 * 7/2019 Torgerson ..... A63B 63/08 473/422

* cited by examiner

POLYGONAL BASKETBALL HOOP ARRANGEMENT

CROSS-REFERENCE TO RELATED APPLICATION

This application claims the benefit of U.S. Provisional Patent Application Ser. No. 62/749,455, filed on Oct. 23, 2018, the contents of which are herein incorporated by reference in their entirety.

FIELD OF THE INVENTION

The present invention relates to basketball equipment, and more particularly, to basketball hoops, backboards and support equipment.

BACKGROUND OF THE INVENTION

The conventional basketball court arrangement includes two hoops and backboards supported or suspended above the ground at opposite ends of the court. Many courts, like courts frequently found in school gymnasiums, will include additional hoops/backboards along sides of the court, allowing smaller practice areas to be carved out of a large full court. While such arrangements are useful, they are often quite expensive to implement, and remain relatively limited with respect to the number of competitors that can usefully practice or play simultaneously.

SUMMARY OF THE INVENTION

According to an embodiment of the present invention, a basketball hoop arrangement includes three basketball backboards and hoops commonly connected to the upper end of a support structure. The backboards are arranged such that respective top and bottom edges thereof form triangles with respective front surfaces of the three basketball backboards facing outwards and respective rear surfaces of the three basketball backboards facing inwards. Each hoop is connected to a different one of the respective front surfaces and extends outwardly therefrom. A lower end of the support structure is configured to support the support structure and the three basketball backboards on an underlying surface.

According to an aspect of the present invention, a height of the support structure is variable. According to another aspect of the present invention, the lower end of the support structure includes a carriage assembly with a plurality of casters allowing the basketball hoop arrangement to be easily moved between desired locations.

According to a method aspect, a basketball game is played using a basketball hoop arrangement having at least three basketball backboards arranged such that respective top and bottom edges thereof form polygons with respective front surfaces of the at least three backboards facing outwards and respective rear surfaces of the at least three basketball backboards facing inwards. A single basketball hoop extends outwardly from each of the respective front surfaces, and a support structure holds the at least three backboards above an underlying surface. The method includes moving a basketball in a playing area extending around all of the at least three backboards, and scoring points by putting the basketball through any one of the at least three hoops.

These and other objects, aspects and advantages of the present invention will be better appreciated in view of the drawings and following detailed description of preferred embodiments.

DETAILED DESCRIPTION OF PREFERRED EMBODIMENTS

Figure 1:
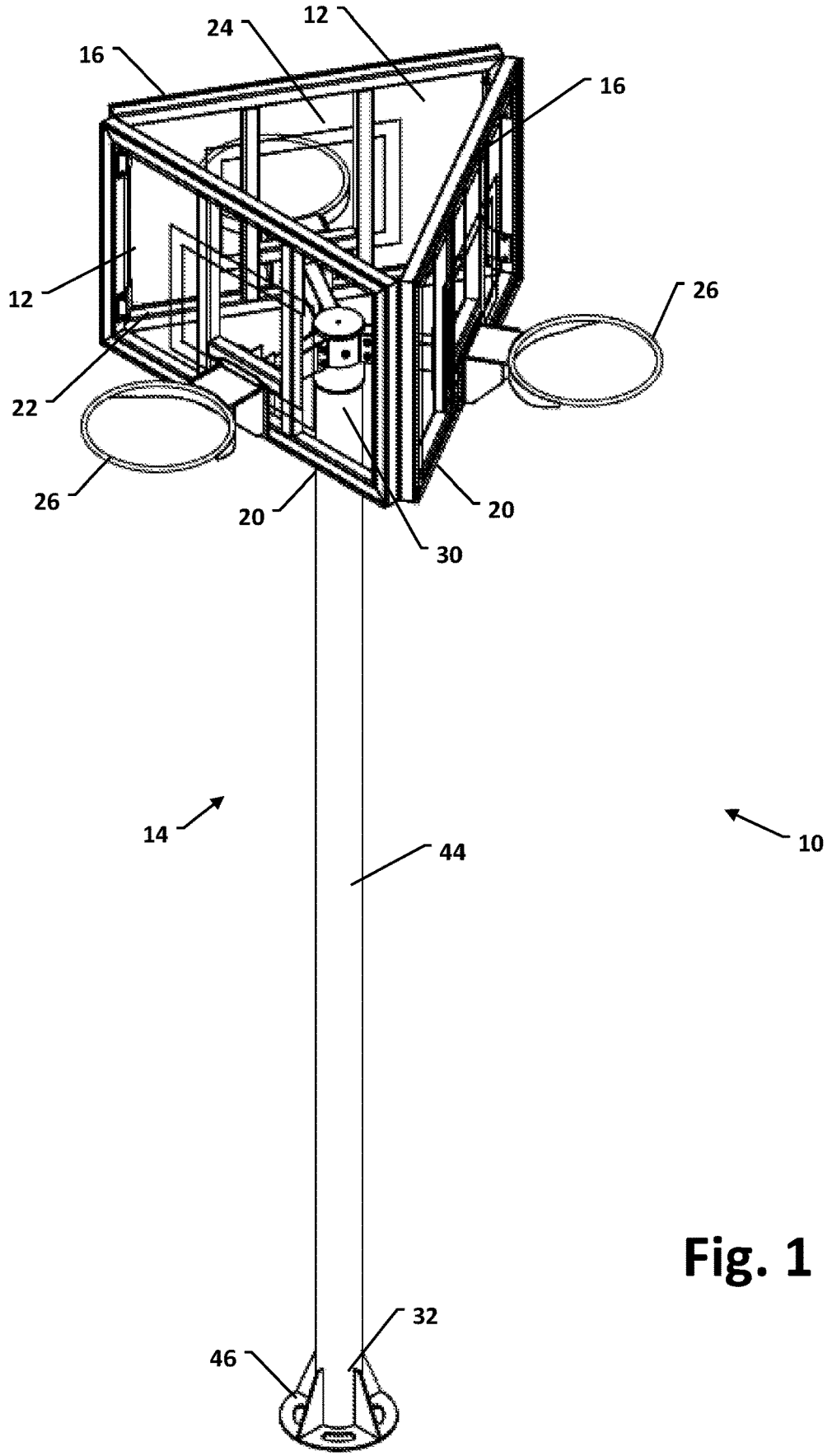
FIG. 1 is a perspective view of a basketball hoop arrangement, according to an embodiment of the present invention.
Figure 2:
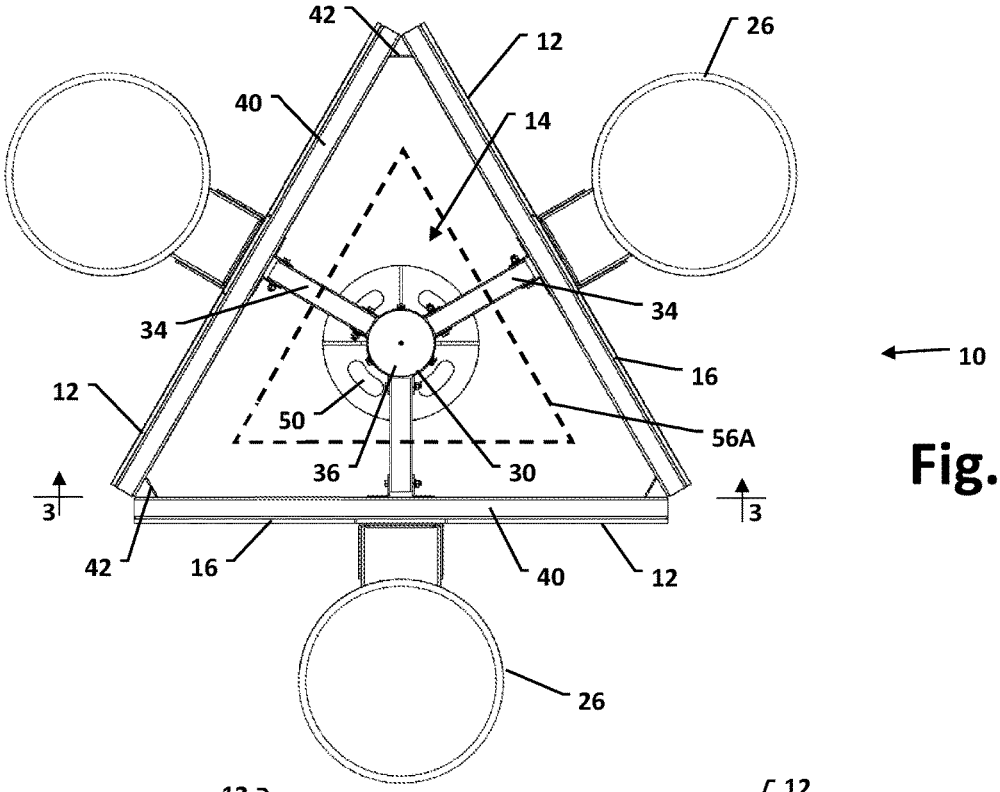
FIG. 2 is a top view of the basketball hoop arrangement of FIG. 1.
Figure 3:
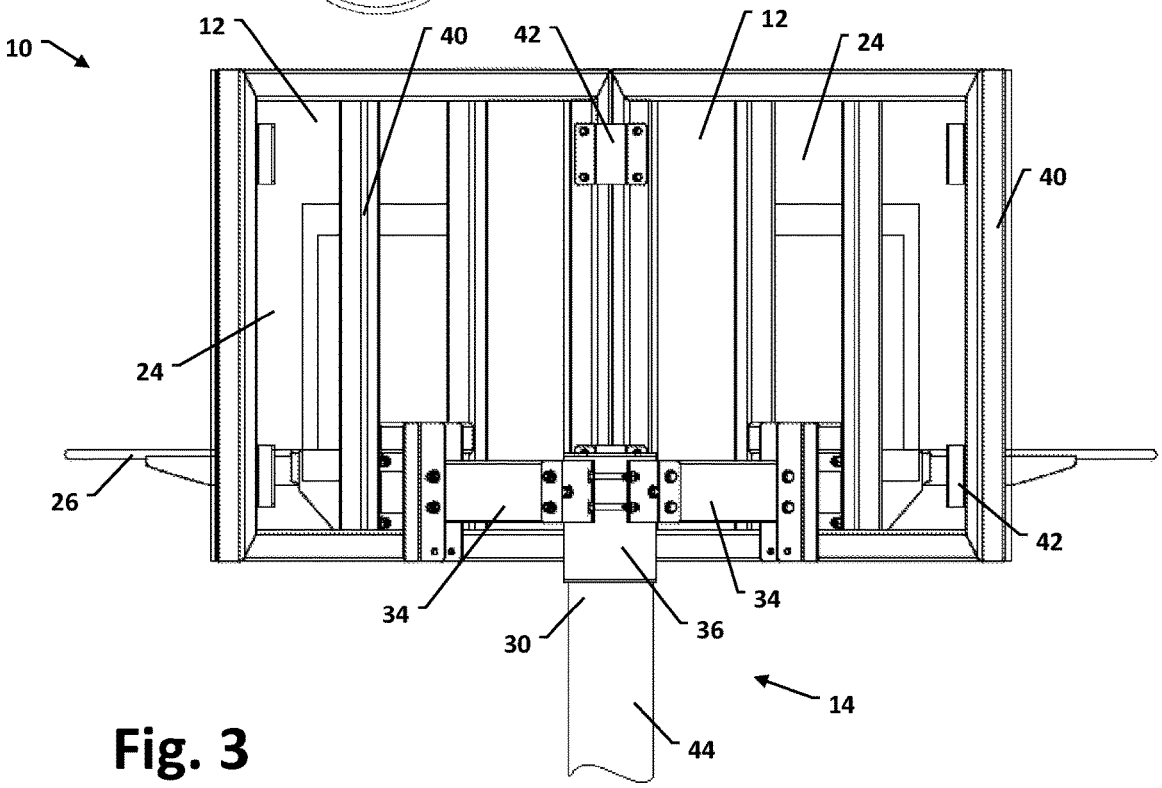
FIG. 3 is a partial sectional view of the basketball hoop arrangement of FIG. 1, taken along line 3-3 of FIG. 2.

Referring to FIGS. 1-3, according to an embodiment of the present invention, a basketball hoop arrangement 10 includes three basketball backboards 12 carried by a support structure 14. The three backboards 12 are arranged such that their top and bottom edges 16, 20 form triangles with their front surfaces 22 facing outwards and their rear surfaces 24 facing inwards. A basketball hoop 26 extends outwardly from each front surface 22.

The support structure 14 extends between an upper end 30, which carries the backboards 12, and a lower end 32 configured to support the arrangement 10 on an underlying surface. At the upper end 30, three support arms 34 extend from a cap 36. Each support arm 34 connects to a mounting frame 40 on the rear surface 24 of a respective one of the backboards 12. Angle brackets 42 connect adjacent sides of the mounting frames 40.

The cap 36 is attached to a central post 44 at the upper end 30. A flange 46 at the lower end 32 has a plurality of slots 50 through which the support structure 14 can be bolted to the underlying surface. The support structure 14 can be made of any suitable material, with non-limiting examples including steel, aluminum and ultra-high-molecular-weight polyethylene (UHMW). Likewise, the backboards 12 and hoops 26 can also be made of any suitable material, with non-limiting examples of backboard materials including acrylic and aluminum. The hoops 26 can attach to the backboards 12 with fixed or breakaway mountings.

Figure 4:
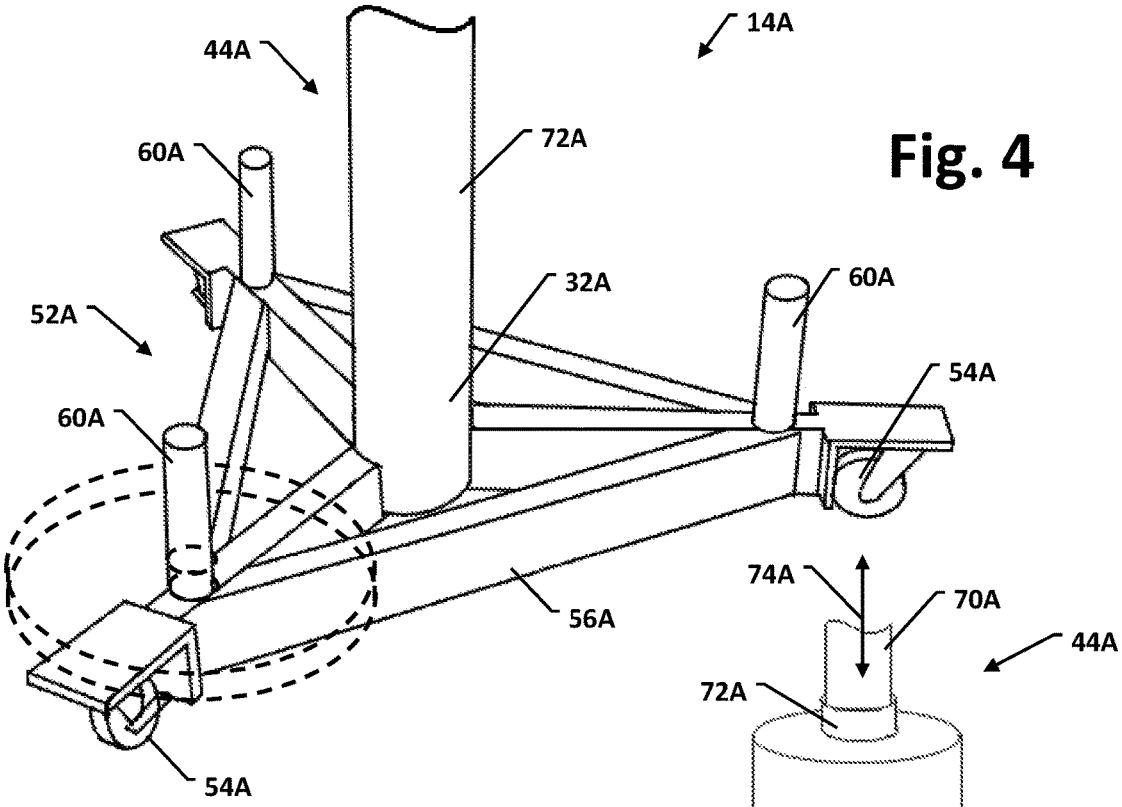
FIG. 4 is a partial perspective view of a support structure of a basketball hoop arrangement, according to an alternate embodiment of the present invention, with padding removed to show internal details.
Figure 5:
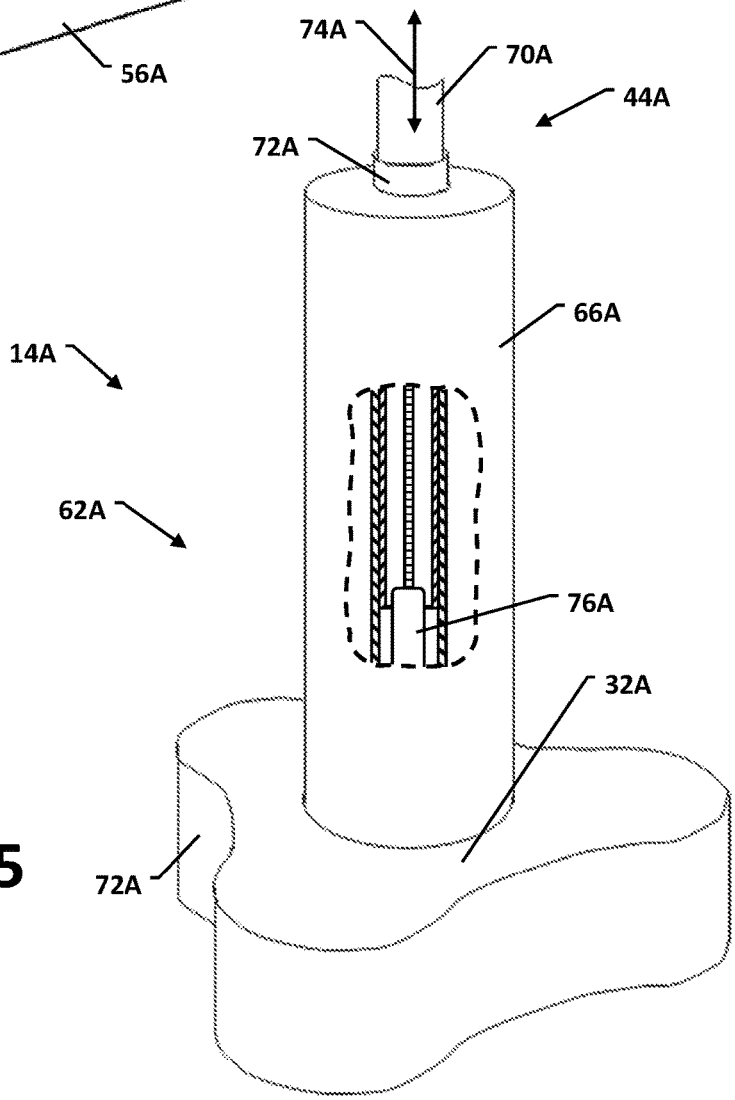
FIG. 5 is a partial perspective view of the support structure of FIG. 4, partially cutaway to show internal details.

The lower end 32 of the support structure 14 depicted in FIGS. 1-3 is configured to be fixed to an underlying surface. Advantageously, the basketball arrangement 10 can also be made portable. Referring to FIGS. 4 and 5, in an alternate embodiment of the support structure 14A, a carriage assembly 52A is connected at the lower end 32A. In the description of this alternate embodiment, similar components will be given the same reference number followed by an "A" (e.g., 32, 32A). It will be appreciated that the upper end of the hoop arrangement 10 remains as shown and described in connection with the foregoing embodiment.

The carriage assembly 52A includes a plurality of casters 54A. The casters 54A are preferably locking casters to immobilize the hoop arrangement 10 temporarily when placed in a desired location. Advantageously, the carriage assembly 52A includes three casters 54A connected by a carriage frame 56A so as to form a triangle. The triangle formed by the casters 54A is preferably commonly oriented with the triangles formed by the top and bottom edges 16, 20 of the backboards 12 (see, e.g., dashed lines in FIG. 2).

To provide additional stability to the hoop arrangement, the carriage assembly 52A includes one or more vertical studs 60A that are dimensioned to receive the central aperture of weight plates. Preferably, there are three vertical studs 60A, each of which is located adjacent to a respective one of the casters 54A.

For added safety, at least a portion of the support structure 14 extending upwardly from the lower end 32 is covered with a padding assembly 62A. In the embodiment of FIGS. 4 and 5, with a carriage assembly 52A, the padding assembly 62A includes a lower section 64A which extends up high enough to cover the carriage assembly 52A and any weight plates on the vertical studs 60A. An upper section 66A has a smaller diameter than the lower section 64A and extends upwardly therefrom to cover more of the central post 44A.

Advantageously, the height of the support structure 14, and thus the height of the backboards 12 and hoops 26, can be made variable. In the support structure 14A, the central post 44A includes telescoping upper and lower sections 70A, 72A. By raising and lowering the upper section 70A relative to the lower section 72A in the directions of arrow 74A, the overall height the hoop arrangement is varied. A drive motor 76A, preferably located internally, is operable to raise and lower the upper section 70A. Although particularly advantageous in connection with the portable support structure 14A, it will be appreciated that a variable height support structure could readily be employed with a support structure configured for fixed attachment to an underlying surface.

Figure 6:
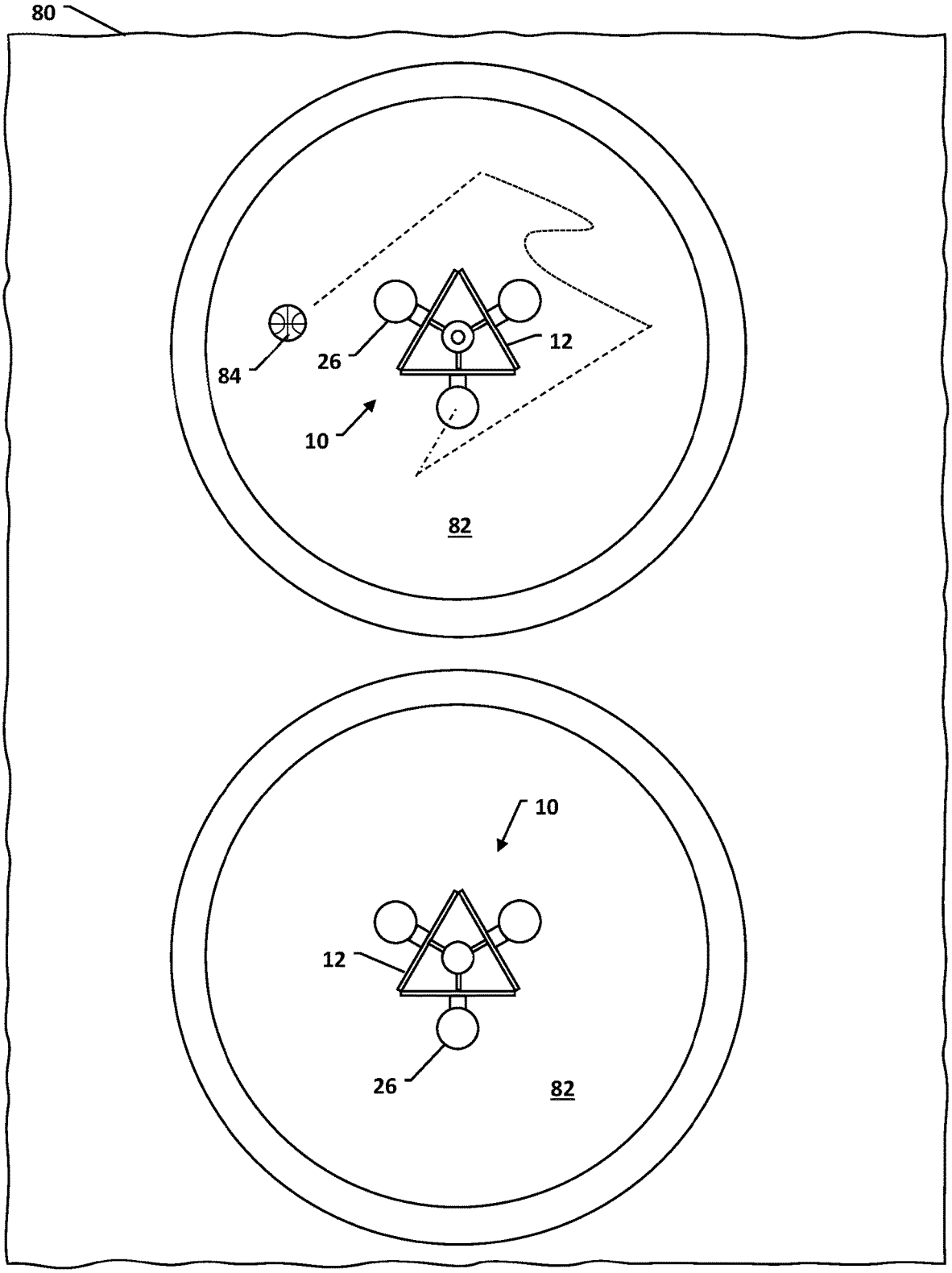
FIG. 6 is a plan view of a plurality of basketball hoop arrangements arranged for use on an underlying surface.

Referring to FIG. 6, it will be appreciated that a plurality of hoop arrangements 10 (or 10A) can be located on an underlying surface 80, allowing multiple playing areas 82 to be realized in a relatively limited space. Within each playing area 82, multiple players can be involved in drills and other games in which a basketball 84 is moved around all of the multiple backboards 12; for example via passing (long dashed lines) and dribbling (short dashed lines). Points can be scored by shooting or otherwise putting the basketball 84 through any of the hoops 26 (e.g., long-short dashed lines).

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A basketball hoop arrangement comprising:

three basketball backboards arranged such that respective top and bottom edges thereof form triangles with respective front surfaces of the three basketball backboards facing outwards and respective rear surfaces of the three basketball backboards facing inwards;

three basketball hoops, each hoop connected to a different one of the respective front surfaces and extending outwardly therefrom; and a support structure having an upper end connected to the three basketball backboards and a lower end for supporting the support structure and the three basketball backboards on an underlying surface wherein the lower end of the support structure includes a carriage assembly supported by a plurality of casters; and wherein the carriage assembly includes a first vertical stud configured to receive at least one weight plate thereon.

2. The basketball hoop arrangement of claim 1, wherein the support structure includes three support arms extending outwardly from the upper end of the support structure, each of the support arms connected to a different one of the respective rear surfaces.

3. The basketball hoop arrangement of claim 1, wherein the support structure includes a central post extending between the upper end and the lower end.

4. The basketball hoop arrangement of claim 3, wherein the support structure further includes three support arms extending outwardly from the central post at the upper end, each of the support arms connected to a different one of the respective rear surfaces.

5. The basketball hoop arrangement of claim 3, wherein the central post includes telescoping upper and lower post sections, such that a distance between the upper end and lower end of the support structure can be changed to alter a height of the three basketball hoops relative to the underlying surface.

6. The basketball hoop arrangement of claim 5, further comprising a drive motor operable to raise and lower the upper post section relative to the lower post section.

7. The basketball hoop arrangement of claim 1, further comprising a padding arrangement arranged around the support structure at the lower end and extending at least part way to the upper end.

8. The basketball hoop arrangement of claim 1, wherein each of the plurality of casters is a locking caster.

9. The basketball hoop arrangement of claim 1, wherein the plurality of casters includes three casters arranged in a triangle commonly oriented with the triangles formed by the top and bottom edges of the three basketball backboards.

10. The basketball hoop arrangement of claim 9, wherein the first vertical stud is located adjacent to a first of the three casters and the carriage assembly further includes second and third vertical studs arranged, respectively, adjacent to a second and third of the three casters.

11. The basketball hoop arrangement of claim 10, wherein the support structure includes a central post extending between the upper end and the lower end.

12. The basketball hoop arrangement of claim 11, further comprising a padding arrangement arranged around the support structure at the lower end and extending at least part way to the upper end, the padding arrangement including a lower padding section covering the carriage assembly and an upper padding section covering at least some of the central post above the carriage assembly, the lower padding section having a greater diameter than the upper padding section.

13. The basketball hoop arrangement of claim 12, wherein the central post includes telescoping upper and lower post sections, such that a distance between the upper end and lower end of the support structure can be changed to alter a height of the three basketball hoops relative to the underlying surface.

14. The basketball hoop arrangement of claim 13, further comprising a drive motor operable to raise and lower the upper post section relative to the lower post section.

15. The basketball hoop arrangement of claim 13, wherein the upper padding section ends below a junction of the upper and lower post sections.

16. A method of playing a basketball game using the basketball hoop arrangement of claim 1, the method comprising:

moving a basketball in a playing area extending around all of the at least three backboards; and scoring points by putting the basketball through any one of the at least three hoops.

17. The method of claim 16, wherein the basketball hoop arrangement is portable and the method comprises an initial step of placing the basketball hoop arrangement on the underlying surface.

* * * * *